United States Patent [19]

Wilson

[11] Patent Number: 4,646,499

[45] Date of Patent: Mar. 3, 1987

[54] ROOFS

[75] Inventor: Frederick G. Wilson, Lisburn, Northern Ireland

[73] Assignee: F. G. Wilson (Engineering) Limited, Belfast, Ireland

[21] Appl. No.: 787,458

[22] Filed: Oct. 15, 1985

[30] Foreign Application Priority Data

Oct. 13, 1984 [GB] United Kingdom ..... 8425914

[51] Int. Cl.[4] ..... E04D 3/24; E04C 2/50

[52] U.S. Cl. ..... 52/408; 52/404; 52/801; 296/211

[58] Field of Search ..... 52/408, 406, 404, 795, 52/809, 309.4, 309.9, 630, 801; 296/210, 211

[56] References Cited

U.S. PATENT DOCUMENTS

| | | | |
|---|---|---|---|
| 1,630,545 | 5/1927 | Smith | 296/211 |
| 1,640,592 | 8/1927 | Bourgon | 296/211 |
| 2,147,059 | 2/1939 | Randall | 296/211 |
| 2,873,008 | 2/1959 | Ashman | 52/801 X |
| 3,003,902 | 10/1961 | McDuff | 52/406 X |
| 3,192,099 | 6/1965 | Beckman et al. | 52/795 X |
| 3,302,358 | 2/1967 | Jackson | 52/406 X |
| 3,715,846 | 2/1973 | Sullhofer | 52/795 X |
| 4,021,981 | 5/1977 | Van Wagoner | 52/408 X |
| 4,125,977 | 11/1978 | Michlovic | 52/801 X |
| 4,499,645 | 2/1985 | Luomanen | 52/309.9 X |

FOREIGN PATENT DOCUMENTS

| | | | |
|---|---|---|---|
| 1958879 | 6/1971 | Fed. Rep. of Germany | 52/309.4 |
| 450793 | 8/1949 | Italy | 296/211 |
| 1125533 | 8/1968 | United Kingdom | 296/211 |
| 661083 | 5/1979 | U.S.S.R. | 52/408 |

*Primary Examiner*—J. Karl Bell

*Attorney, Agent, or Firm*—Mason, Fenwick & Lawrence

[57] ABSTRACT

A roof of corrugated sheet material having profiled cross-section of alternate troughs and ridges. The troughs have adhered therein a filler material to fill the troughs to at least a level flush with the level of the ridges on each side thereof. A waterproof sheet covering is located and adhered over the whole extent of the roof. The troughs may have a substantially greater width than the width of the ridges. The filler material may be in the form of elongated blocks or a panel of heat insulating material. The roof may be formed in sections, juxtaposed and attached to side walls of a structure such as a vehicle prior to the covering being adhered thereto.

5 Claims, 2 Drawing Figures

ROOFS

This invention relates to roofs more particularly, but not exclusively, for high-sided self-propelled or trailer vehicles and relates particularly to roofs formed from sheet material corrugated for strength to give a profiled cross-section of alternate troughs and ridges.

A disadvantage of this type of roof is that the corrugations are usually flattened at both ends of the sheet so that rainwater which collects in the troughs is allowed to run off and this in fact weakens the sheet material at these points.

It is an object of the present invention to obviate or mitigate this disadvantage.

Accordingly, the invention comprises a roof characterised in that the troughs have adhered therein a filler material to fill the troughs to at least a level flush with the level of the ridges on each side thereof and a waterproof sheet covering located and adhered over the whole extent of the roof.

Figure 1:
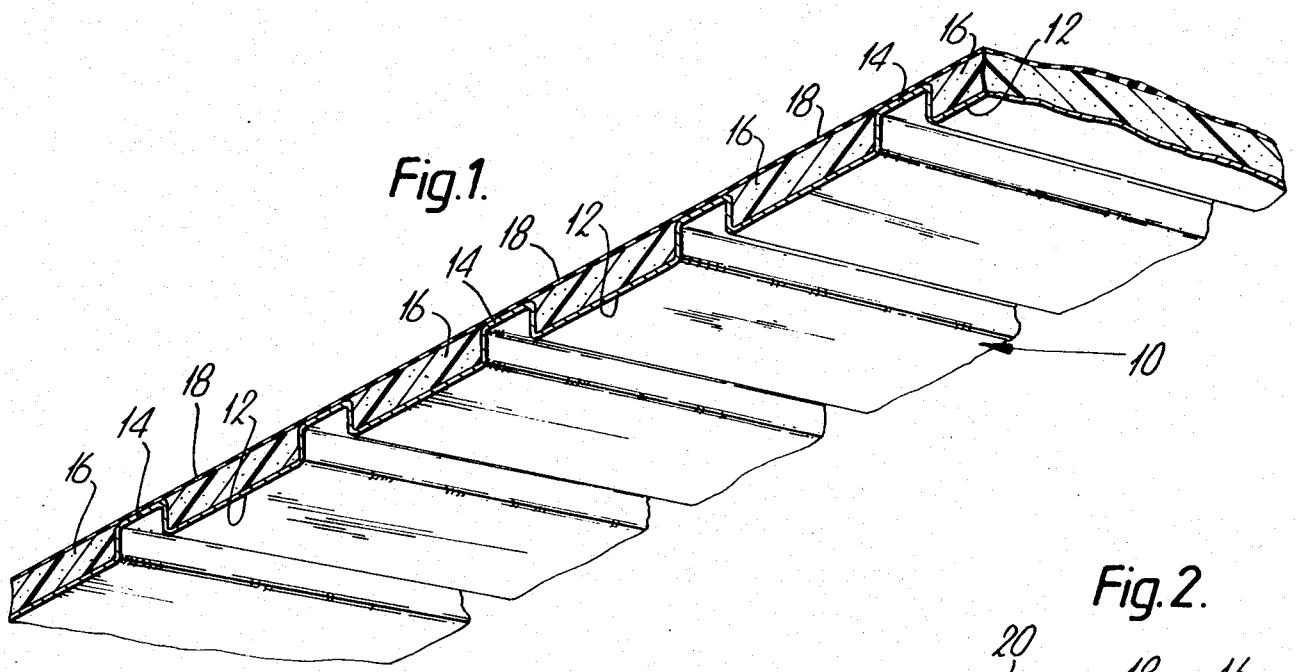
Figure 2:
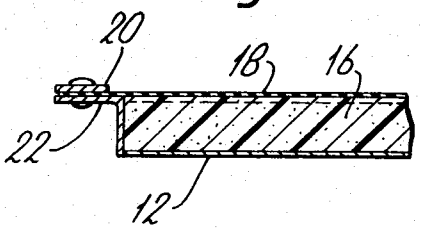

An embodiment of the present invention will now be described, by way of example, with reference to the accompanying drawing in which:

FIG. 1 is a perspective view from below, part cutaway, of a portion of a vehicle roof; and FIG. 2 is an end sectional view of part of the roof of FIG. 1 showing an edge thereof.

The roof of a high-sided self-propelled or trailer vehicle is formed of sheet material 10 of metal, such as steel, which is corrugated for strength to give a profiled cross-section of shallow alternate U-shaped troughs 12 and top hat shaped ridges 14. The shallow ridges 14 may be 12 mm deep and 12 mm wide with the troughs 12 being 75 mm wide and 12 mm deep.

The roof may be formed of a plurality of sheets of dimensions 8 feet by 4 feet. The individual sheets of corrugated material are placed into position with the webs of the top hat ridges 14 level with the top of the lateral sides of the vehicle. The sheets are then welded into position by stitch welding and the other sheets required are abutted and stitch welded along their length. Filler material 16 is filled and adhered into each of said troughs 12 to a level flush with the level of the webs of the ridges 14. The material is suitably in the form of elongate blocks or panels of a heat insulation material, such as expanded polystyrene glued to the webs and limbs of the respective troughs 12.

A waterproof or weatherproof sheet covering 18 such as synthetic rubber is provided to be adhered over the extent of said roof.

To secure the edges of the covering, a strip or strap 20 of metal or alloy is riveted or bolted to a longitudinally extending angle bracket 22 attached to the edges of the roof with the edges of the covering sandwiched therebetween.

In an alternative arrangement (not shown) the filler material 16 may be in the form of a single panel which locates over and is adhered to a roof section. In this case the filler material extends over the ridges 14 as well as filling the troughs 12.

In either of the arrangements described the ridges 14 may also be filled with heat insulating material from below, either with blocks or a single panel extending over a roof section. This adds considerable insulation to the roof and for refrigeration purposes could extend a considerable distance below the under surface of the troughs 12.

Although described for use with a vehicle the roof could also be used with pre-fabricated static buildings, garages, sheds etc.

The insulation material adds a considerable strength to the roof and provides a high degree of heat insulation.

What I claim is:

1. A vehicle having a roof comprising:

(a) a rigid corrugated sheet material having a profiled cross-section of alternate troughs and ridges, the width of the troughs being substantially greater than the width of the ridges, and the width of the troughs being substantially greater than the depth thereof, (b) a filler material, the filler material being adhered to fill the troughs to a level substantially flush with the level of the ridges on each side thereof; and (c) a waterproof sheet covering, the covering being located and adhered over the whole extent of the roof and comprising the upper surface of the roof.

2. A vehicle as claimed in claim 1 wherein the filler material is in the form of elongated blocks of heat insulating material.

3. A vehicle as claimed in claim 1 wherein a filler of heat insulating material is located and adhered to fill the ridges from beneath to a level at least flush with the level of the under surfaces of the troughs.

4. A vehicle as claimed in claim 1 wherein a filler material is located and adhered to fill the ridges from beneath to a level at least flush with the level of the under surfaces of the troughs, such filler material being in the form of elongated blocks of heat insulating material.

5. A vehicle as claimed in claim 1, further comprising a pair of opposed side walls, wherein the roof is formed in sections, juxtaposed and attached to the side walls prior to the covering being adhered thereto.

* * * * *